US006072270A

United States Patent [19]

Hu et al.

[11] Patent Number: 6,072,270

[45] Date of Patent: Jun. 6, 2000

[54] SHADOW MASK FOR COLOR CRT

[75] Inventors: Yu-Shin Hu, Hsinchu; Ching-Hsiang Tseng, Yangmei; Kuo-Cheng Chen, Sanchong, all of Taiwan

[73] Assignee: Chunghwa Picture Tubes, Inc., Taoyuan, Taiwan

[21] Appl. No.: 09/102,201

[22] Filed: Jun. 22, 1998

[51] Int. Cl.[7] ..... H01J 29/80

[52] U.S. Cl. ..... 313/402; 313/403

[58] Field of Search ..... 313/402, 403

[56] References Cited

U.S. PATENT DOCUMENTS

| | | | |
|---|---|---|---|
| 3,735,190 | 5/1973 | Say | 315/13 |
| 4,300,069 | 11/1981 | Nolan | 313/403 |
| 5,072,150 | 12/1991 | Lee | 313/405 |
| 5,126,624 | 6/1992 | Ji | 313/402 |
| 5,210,459 | 5/1993 | Lee | 313/406 |
| 5,534,746 | 7/1996 | Marks et al. | 313/408 |

*Primary Examiner*—J. P. Patel
*Attorney, Agent, or Firm*—Emrich & Dithmar

[57] ABSTRACT

In a shadow mask employed as a color selection electrode in a multi-electron beam color cathode ray tube (CRT), the surface area of the mask is reduced by increasing the length of the individual elongated beam passing apertures, or slots, while reducing the ratio of the width of the bridge portion of the mask between adjacent apertures to the length of the aperture. Increasing the length of the apertures while reducing the ratio of bridge width to aperture length reduces the surface area of the mask upon which energetic electrons are incident resulting in a corresponding reduction in thermal deformation, or doming, of the shadow mask. Reduction in shadow mask doming results in reduced landing shift of the electron beams incident on phosphor elements disposed on the inner surface of the CRT's display screen for improved video image brightness and color purity. More specifically, in a shadow mask having a thickness in the range of 0.12–0.18 mm with slotted apertures, the length of the slots is in the range of 0.90–10.00 mm and the ratio of bridge width to slot length is in the range of 0.001–0.110. With this invention, electron beam transmission through the shadow mask can be increased by as much as 22% resulting in a reduction in beam landing shift error by as much as 20 $\mu$m. Video image brightness is increased by as much as 17% and the color purity adjustment margin is increased to over 10 $\mu$m in, for example, a color CRT with a 20 inch display screen.

3 Claims, 1 Drawing Sheet

SHADOW MASK FOR COLOR CRT

FIELD OF THE INVENTION

This invention relates generally to color cathode ray tubes (CRTs) and is particularly directed to a color CRT shadow mask, or color selection electrode, having electron beam passing apertures and a reduced surface area upon which the electron beams are incident and which exhibits reduced thermal deformation and affords reduced electron beam landing shift error.

BACKGROUND OF THE INVENTION

Most current color CRTs employ a shadow mask separated by a designated distance from a phosphor-coated luminescent glass display screen. The shadow mask serves as a color selection electrode for selectively guiding electron beams emitted from electron guns onto designated phosphor coated portions on the luminescent screen formed on the inner surface of the display panel. The shadow mask is in the form of a thin metal sheet with a large number of electron beam passing apertures and is attached to a rigid peripheral frame. The frame is attached to and supported by an inner portion of the CRT's glass envelope.

The large number of small apertures in the shadow mask allow each of the three electron beams to be incident upon selected phosphor deposits on the inner surface of the display panel. Because apertures represent only approximately 20% of the total area of the shadow mask, approximately 80% of the energy of the electron beams is absorbed by the shadow mask and converted to heat energy as the electron beams impinge upon the shadow mask structure. This heat absorption by the shadow mask causes thermal deformation of the mask, which is commonly referred to as mask "doming." Doming of the shadow mask gives rise to a shift in electron beam landing position relative to the phosphor elements deposited on the display panel. This electron beam landing shift appears to the viewer as a degradation in video image brightness and color purity. Electron beam shift and the corresponding degradation in video image brightness and color purity increase with more closely spaced mask apertures i.e., finer aperture pitch, and flatter shadow masks, which are the trends in current color CRT design. A portion of the shadow mask connecting adjacent beam passing apertures is known as a "bridge" and serves as a mechanical support for the shadow mask. Each shadow mask bridge also serves as a barrier preventing at least a portion of the electron beam from penetrating the shadow mask and impinging on the CRT's display panel. Thus, the shadow mask bridges support and strengthen the shadow mask, but also contribute to thermal deformation of the mask and associated mask doming.

The present invention addresses the aforementioned limitations of the prior art by reducing shadow mask doming by reducing the number and sizes of the bridges extending between adjacent apertures in the mask.

OBJECTS AND SUMMARY OF THE INVENTION

Accordingly, it is an object of the present invention to provide reduced electron beam landing shift in a color CRT caused by thermal deformation of the CRT's slotted aperture shadow mask.

It is another object of the present invention to reduce the number of bridges which serve as mechanical supports between adjacent slots in a color CRT shadow mask thus reducing doming of the shadow mask caused by energetic electrons impinging on the bridges.

Yet another object of the present invention is to improve video image color purity and brightness in a color CRT by reducing thermal deformation, or doming, of the CRT's shadow mask, or color selection electrode, by increasing the length of the mask's electron beam passing slotted apertures.

The present invention contemplates a shadow mask for use in a color cathode ray tube (CRT) having a plurality of electron beams and a display panel for presenting a video image, the shadow mask comprising a generally planar metal sheet having a thickness in the range of 0.12–0.18 mm; a plurality of elongated, aligned, generally linear apertures in the metal sheet, wherein the apertures are arranged in parallel, spaced linear arrays aligned along a longitudinal axis of the apertures and wherein each of the apertures is adapted to pass a respective electron beam and has a length in the range of 0.90–10.00 mm; and a plurality of bridge portions of the metal sheet disposed intermediate adjacent apertures in the metal sheet, wherein each bridge portion has a length and a width and wherein a ratio of the width of a bridge portion to the length of an aperture is in the range of 0.001–0.110.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
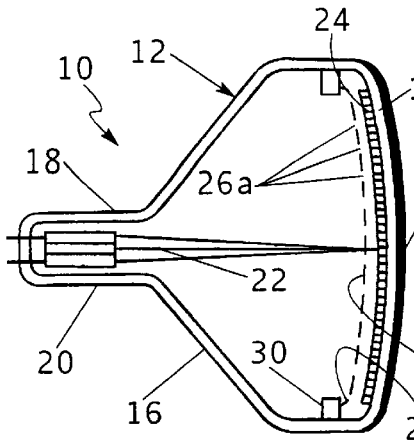
FIG.1 (PRIOR ART)
FIG. 1 is a simplified lateral sectional view of a conventional color CRT incorporating a shadow mask.

Referring to FIG. 1, there is shown a sectional view of a conventional color CRT 10 incorporating an apertured shadow mask 26. The CRT 10 includes a sealed glass envelope 12 having a forward faceplate or display screen 14, an aft neck portion 18, and an intermediate funnel portion 16. Disposed on the inner surface of glass faceplate 14 is a phosphor screen 24 which includes a plurality of discrete phosphor deposits, or elements, which emit light when an electron beam is incident thereon to produce a video image on the faceplate. The color CRT 10 includes three electron beams 22 directed onto and focussed upon the CRT's glass faceplate 14. Disposed in the neck portion 18 of the CRT's glass envelope 12 are a plurality of electron guns 20 typically arranged in an inline array for directing the electron beams 22 onto the phosphor screen 24. Electron beams 22 are deflected vertically and horizontally in unison across the phosphor screen 24 by a magnetic deflection yoke which is not shown in the figure for simplicity. Disposed in a spaced manner from phosphor screen 24 is the aforementioned shadow mask 26 having a plurality of spaced electron beam passing apertures 26*a* and a skirt portion 28 around the periphery thereof. The shadow mask skirt portion 28 is securely attached to a shadow mask mounting fixture 30 around the periphery of the shadow mask. The shadow mask mounting fixture 30 is attached to an inner surface of the CRT's glass envelope 12 and may include conventional attachment and positioning structures such as a mask attachment frame and mounting springs which are described below. The shadow mask mounting fixture 30 is attached to the inner surface of the CRT's glass envelope 12 by conventional means such as weldments or a glass-based frit and the shadow mask 26 is attached to the mounting fixture also by conventional means such described below.

Figure 2:
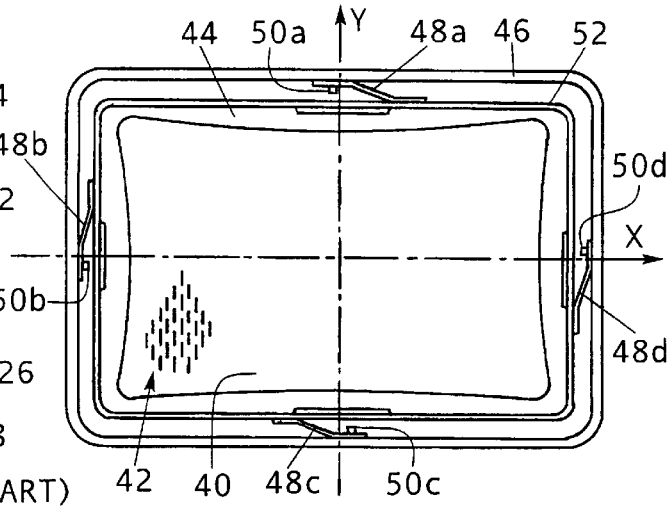
FIG.2 (PRIOR ART)
FIG. 2 is a front elevation view of a conventional apertured shadow mask installed in and attached to the glass envelope of the color CRT as shown in FIG. 1.

Referring to FIG. 2, there is shown a plan view of a conventional shadow mask 40 and details of the manner in which the shadow mask is mounted within the CRT's glass envelope 46. The shadow mask 40 includes a plurality of spaced beam passing apertures 42 (only a portion of which are shown in the figure for simplicity). Each of the shadow mask apertures 42 is elongated, having its longitudinal axis aligned generally vertically. The beam passing apertures 42 are located in an inner portion of the shadow mask 40 which is maintained under tension and is in closely spaced relation from the CRT's glass faceplate. Disposed about the apertured inner portion of the shadow mask 40 is a shadow mask skirt 44. Attached to and disposed about the shadow mask skirt 44 is a shadow mask frame 52 having a generally rectangular shape. Disposed about the shadow mask frame 52 in a spaced manner are four resilient metal holders, or springs, 48*a*, 48*b*, 48*c* and 48*d*. The four resilient metal holders 48*a*, 48*b*, 48*c* and 48*d* are securely attached to the shadow mask frame 52 by conventional means such as weldments. Each resilient metal holder 48*a*, 48*b*, 48*c* and 48*d* includes an aperture for receiving a respective mounting stud 50*a*, 50*b*, 50*c* and 50*d*. Each of the mounting studs 50*a*, 50*b*, 50*c* and 50*d* is attached to a respective inner flat surface of the CRT's glass envelope 46 using conventional means such as a glass frit. The mounting studs 50*a*, 50*b*, 50*c* and 50*d* inserted through respective apertures in the resilient metal holders 48*a*, 48*b*, 48*c* and 48*d* securely maintain the shadow mask 40 in fixed position within the CRT's glass envelope 46 and in spaced relation from the CRT's glass faceplate, or display panel.

Figure 3:
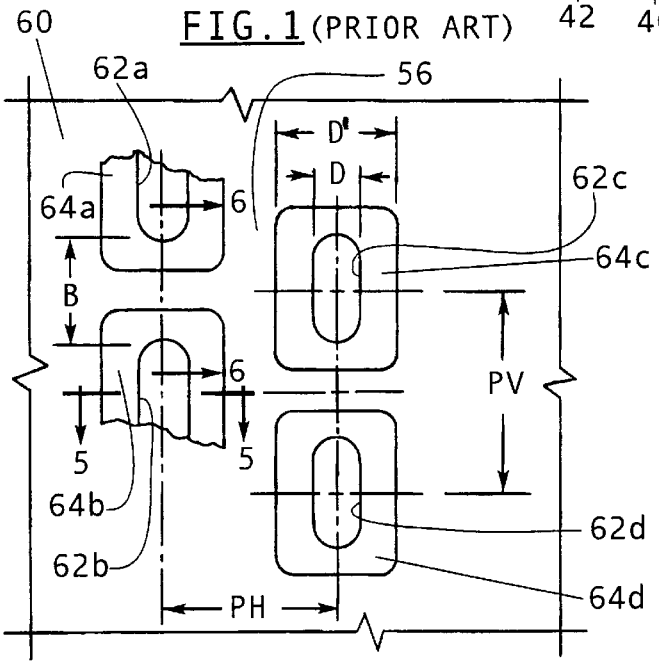
FIG.3 (PRIOR ART)
FIG. 3 is a plan view showing details of the arrangement of beam passing apertures in a conventional shadow mask in a color CRT.
Figure 4:
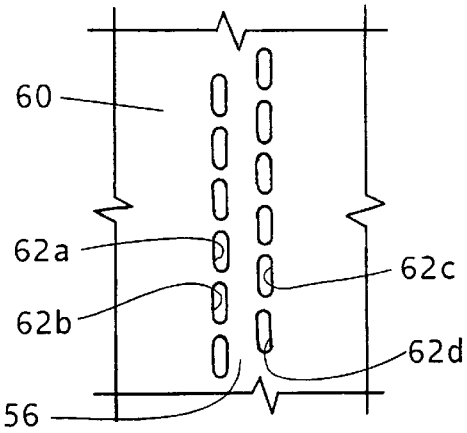
FIG.4 (PRIOR ART)
FIG. 4 is a plan view of a larger surface area of the shadow mask shown in FIG. 3 illustrating the arrangement of additional beam passing apertures in the mask.

Referring to FIG. 3, there is shown a portion of a typical shadow mask 60 illustrating four of the many beam passing apertures in the mask. The four beam passing apertures in the shadow mask 60 are identified as elements 62*a*, 62*b*, 62*c* and 62*d*. For simplicity, apertures 62*a* and 62*b* are shown partially. A larger portion of shadow mask 60 is shown in the plan view of FIG. 4 illustrating the arrangement of a larger number of beam passing apertures in the shadow mask including the four beam passing apertures 62*a*, 62*b*, 62*c* and 62*d* shown in FIG. 3. Disposed about each of the four apertures 62*a*, 62*b*, 62*c* and 62*d* are respective recessed portions 64*a*, 64*b*, 64*c* and 64*d* in shadow mask 60. For simplicity, these recessed portions are omitted from FIG. 4. Each of the four recessed portions 64*a*, 64*b*, 64*c* and 64*d* is formed as a result of the manner in which the apertures are formed in the shadow mask 60 i.e., by chemical etching. As shown in FIGS. 3 and 4, each of the apertures is in the shape of an elongated slot having its longitudinal axis aligned generally vertically. A bridge portion for the shadow mask 60 identified as element 56 is disposed between adjacent columns and rows of apertures and serves as a mechanical support for the mask. The bridge also functions as a barrier for preventing the electron beams from penetrating the shadow mask and impinging upon the CRT's glass faceplate.

Figure 5:
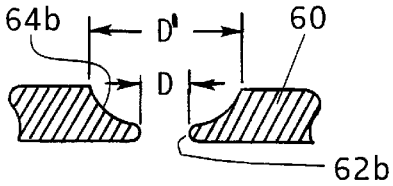
FIGS. 5 and 6 are sectional views of the array of apertures in the shadow mask shown in FIG. 3 taken respectively along site lines 5—5 and 6—6 therein.
Figure 6:
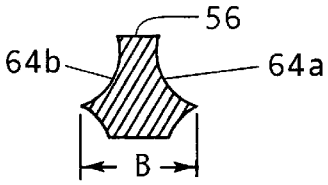

Additional details of the shadow mask apertures and associated adjacent recessed portions in the shadow mask are shown in the sectional views of FIGS. 5 and 6, respectively taken along site lines 5—5 and 6—6 in FIG. 3. As shown in FIG. 5, the recessed portion 64*b* adjacent aperture 62*b* has a width D', while the aperture itself has a width D. As shown in FIG. 6, recessed portions 64*a* and 64*b* respectively disposed about apertures 62*a* and 62*b* are separated by bridge portion 56.

As shown in FIG. 3, the distance between adjacent apertures along the longitudinal axes of the apertures is given by PV. The distance between the closest edges of adjacent apertures along the longitudinal axes of the apertures is given by B. Therefore, the length of each shadow mask aperture is expressed as PV-B. In conventional color CRT's, the length of the shadow mask apertures is expressed in terms of PV-B is in the range of 0.60–0.75 mm.

Also with reference to FIG. 3, the width of the shadow mask aperture is designated D. The width of the recessed, or etched out portion, adjacent to each mask aperture is given as D'. The distance between the longitudinal axes of adjacent shadow mask apertures is given as PH. In a conventional 20 inch CRT, the width of the mask aperture (D) is 0.105 mm, the bridge width (B) is 0.095 mm, the horizontal pitch (PH) is 0.37 mm, and the vertical pitch (PV) is 0.47 mm. The transmission of an electron beam through the shadow mask in terms of the above discussed parameters is given by the expression:

$$\frac{(PV - B - D)D + \pi D^2/4}{PH \times PV} \tag{1}$$

Figure 7:
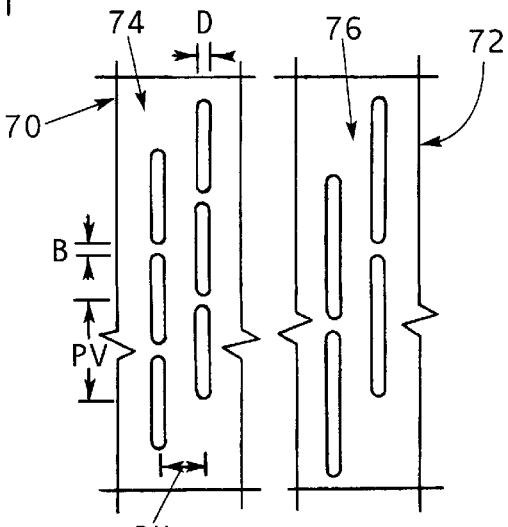
FIG. 7 is a partial plan view of a pair of shadow masks each including a beam passing aperture arrangement in accordance with the present invention.

Referring to FIG. 7, there are shown two arrangements of beam passing apertures in two shadow masks 70 and 72 in accordance with the principles of the present invention. Shown in FIG. 7 are first and second groups of electron beam passing apertures 74 and 76 respectively disposed in shadow masks 70 and 72. A shadow mask in accordance with the present invention has either the first group of apertures 72 or the second group of apertures 74 therein, or would have an aperture arrangement with dimensions in the range between those of the first and second groups of apertures as described below.

In accordance with one aspect of the present invention, the vertical pitch (PV) is increased to a range of from 0.47 mm ($PV_0$) to 0.94 mm ($PV_n$). Increasing the vertical pitch, or the distance between adjacent apertures along their longitudinal axes, to the aforementioned range increases the transmission of the electron beams through the shadow mask by at least 17%. This is the aperture arrangement shown in the first group of apertures 74 in the first shadow mask 70 in FIG. 7, where PV=0.47–0.94 mm. Further increasing the vertical pitch value to 1.41 mm as shown for the case of the second group of apertures 76 in the second shadow mask 72 results in a further increase in the transmission of electron beams through the shadow mask of more than 22%. For a 20 inch CRT, an increase in electron beam transmission of 10% produces a corresponding reduction in electron beam landing shift of approximately 13 $\mu$m. With the greater increase in electron beam transmission, improvements in electron beam landing shift become even more significant. For example, a 17% increase in electron beam transmission through the shadow mask will produce an improvement (or a reduction) of electron beam landing shift as high as 20 $\mu$m.

An explanation of the increase in video image brightness such as in a typical 20 inch CRT made possible by the present invention follows. The width of a black matrix aperture in a conventional shadow mask is on the order of 80 $\mu$m and is represented as $S_0$. $\lambda$ represents the magnification factor of the shadow mask aperture. An improvement in the brightness of the video image can be expressed using the above discussed parameters as follows:

$$\frac{(\lambda \times S_0(PV_n - B) - \lambda \times S_0(PV_n / PV_0)(PV_0 - B)}{\lambda \times S_0(PV_n / PV_0)(PV_0 - B)} \quad (2)$$

Increasing PV from 0.47 mm to 0.94 mm results in a 13% increase in video image brightness. Further increasing PV to 1.41 mm results in a 17% increase in video image brightness.

The increase in video image brightness realized by the present invention also gives rise to a corresponding increase in color purity adjustment margin is explained as follows. The expression for the width $S_n$ of the black matrix hole of a shadow mask for a 20 inch CRT having an aperture array in accordance with the present invention is given by the following expression:

$$S_n = \frac{S_0(PV_n / PV_0)(PV_0 - B)}{PV_n - B} \quad (3)$$

From this equation, it can be shown that an increase in the vertical pitch (PV) between adjacent shadow mask apertures of from 0.47 mm to 1.41 mm will produce an increase in the color purity adjustment margin of more than 10 $\mu$m.

There has thus been shown an improved shadow mask for a color CRT having a reduced bridge width between adjacent beam passing apertures. The reduced surface area of the shadow mask allows for an increase in electron beam transmission through the mask and a reduction in mask thermal deformation, or doming. Reduction in shadow mask doming gives rise to reduced landing shift of the electron beams incident upon designated phosphor elements disposed on the inner surface of the CRT's display screen for improved video image brightness and color purity. The present invention is particularly adapted for use in thin shadow masks having a thickness in the range of 0.12–0.18 mm with vertically elongated apertures. The length of the elongated apertures is in the range of 0.90–10.00 mm and the ratio of bridge width to slot length is in the range of 0.001–0.110 in accordance with the present invention. Electron beam transmission through a shadow mask in accordance with the present invention can be increased by as much 22% resulting in a reduction in beam landing shift error by as much as 20 $\mu$m. Video image brightness is increased by as much as 17% and the color purity adjustment margin is increased to over 10 $\mu$m in a 20 inch CRT.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A shadow mask for use in a color cathode ray tube (CRT) having a plurality of electron beams and a display panel for presenting a video image, said shadow mask comprising:

a generally planar metal sheet having a thickness in the range of 0.12–0.18 mm;

means for defining a plurality of elongated, aligned, generally linear apertures in said metal sheet, wherein said apertures are arranged in parallel, spaced linear arrays aligned along a longitudinal axis of said apertures and wherein each of said apertures is adapted to pass a respective electron beam and has a length in the range of 0.90–10.00 mm; and a plurality of bridge portions of said metal sheet disposed intermediate adjacent apertures in said metal sheet, wherein each bridge portion has a length and a width and wherein a ratio of the width of a bridge portion to the length of an aperture is in the range of 0.001–0.110.

2. The shadow mask of claim 1, wherein adjacent apertures in each of said linear arrays of aligned apertures are spaced in the range of 0.94–1.41 mm apart.

3. The shadow mask of claim 2, wherein the width of the bridge portions of said metal sheet is on the order of 0.095 mm.

* * * * *